United States Patent [19]

Haselberger et al.

[11] Patent Number: 4,883,009

[45] Date of Patent: Nov. 28, 1989

[54] METHOD OF AND APPARATUS FOR PROCESSING TEXTILE MATERIAL WEBS, ESPECIALLY FOR THE MANUFACTURE OF QUILTS AND THE LIKE

[75] Inventors: Franz Haselberger, Hard, Austria; Peter Vogel, Platz-Walzenhausen, Switzerland

[73] Assignee: Fritz Gegauf AG, Steckborn, Switzerland

[21] Appl. No.: 252,601

[22] Filed: Oct. 3, 1988

[30] Foreign Application Priority Data

Oct. 6, 1987 [CH] Switzerland ..... 3919/87

[51] Int. Cl.[4] ..... D05B 21/00; D05B 11/00; D05C 3/00

[52] U.S. Cl. ..... 112/266.1; 112/118; 112/121.14; 112/121.26

[58] Field of Search ..... 112/266.1, 266.2, 117, 112/118, 119, 102, 121.26, 121.14, 121.12

[56] References Cited

U.S. PATENT DOCUMENTS

| | | | |
|---|---|---|---|
| 2,236,421 | 3/1941 | Boettcher | 112/118 |
| 2,501,240 | 3/1950 | Schwartz | 112/118 |
| 3,044,426 | 7/1962 | Schwarzberger | 112/117 |
| 3,354,850 | 11/1967 | Story | 112/118 |
| 3,960,095 | 6/1976 | Story | 112/118 |
| 4,408,552 | 10/1983 | Kondo et al. . | |
| 4,432,296 | 2/1984 | Grondin . | |

FOREIGN PATENT DOCUMENTS 526716 10/1921 France .

*Primary Examiner*—H. Hampton Hunter
*Attorney, Agent, or Firm*—Werner W. Kleeman

[57] ABSTRACT

In the quilting machine the loosely superposed cover material webs and at least one filler material web, while being drawn into the quilting machine, are joined along their marginal portions by means of joining devices which are arranged laterally of the superposed webs. The web sections or selvedges lying outside the formed seams are separated and removed.

9 Claims, 4 Drawing Sheets

METHOD OF AND APPARATUS FOR PROCESSING TEXTILE MATERIAL WEBS, ESPECIALLY FOR THE MANUFACTURE OF QUILTS AND THE LIKE

BACKGROUND OF THE INVENTION

The present invention broadly relates to a method of, and apparatus for, forming quilts and, more specifically, pertains to a new and improved method of processing textile material webs, especially for the manufacture of quilts and the like, and to a new and improved apparatus for processing textile material webs, particularly for the section-by-section or unit manufacture of multi-layer quilts and the like.

Generally speaking, in the practice of the method aspects of the present invention for the processing of textile material webs in a quilting machine, especially for the manufacture of quilts and the like, the cover material webs and the at least one filler material web are withdrawn from a material stock or support, stretched in a tenter frame guidable forth and back under a sewing device, quilted in the tenter frame and subsequently led out of the quilting machine.

As to the apparatus aspects of the present development such pertains to a quilting machine comprising a sewing or stitching device, a material stock or supply from which cover material webs and at least one filler material web can be withdrawn, a tenter frame guidable forth and back or reciprocated beneath the sewing or stitching device. In the quilting machine the cover material webs and the at least one filler material web are stretched and quilted. There are also provided means for leading or withdrawing the quilted material webs out of the quilting machine.

Quilts and the like consist of several layers of flat textile webs, generally of one or several layers formed of cotton or of a fiber filling or padding as well as a top layer of cover material and a bottom layer of cover material. These layers are sewn or stitched together at seams which usually extend in an ornamental pattern or design.

The superposed fabric materials and inserts must be held together during the quilting or stitching operation, so that no mutual shifting or displacement can take place during working or processing thereof. For this purpose, the individual layers are fed to the quilting or stitching machine, stretched in a frame or held between pairs of rolls and thus accurately positioned, before they can be sewn or stitched together.

In an automatic quilting machine as known from U.S. Pat. No. 3,960,095, granted June 1, 1976, the fabric material webs and padding webs supplied from rolls are guided into a longitudinally and transversely movable material holding carriage and clamped therein with the assistance of retaining or holding means mounted along such carriage. During the sewing operation, the material holding carriage moves longitudinally as well as transversely beneath the stationary sewing head, which are fixedly arranged at a transversely extending beam above the material holding carriage. The already sewn or quilted sections of the material webs and the not yet sewn, only loosely superposed ingoing material webs located externally of the material holding carriage, during the sewing operation hang in looped form between a pair of take-up or tension rollers arranged at the discharge station and a clamping bar arranged at the front end of the material holding carriage as well as between fluid actuated cylinders at the feed station and a clamping bar arranged at the rear end of the material holding carriage.

This prior art apparatus renders possible a faultless and reproducible sewing of the different layers stretched out in the material holding carriage. However, the ingoing and only loosely superposed webs of fabric material and webs of padding, which are moved forth and back as well as laterally by the movement of the material holding carriage, tend to be mutually shifted with respect to one another, depending on the characteristics of the individual components. This undesirable web shifting can cause the formation of web sections without padding and/or local accumulations of padding or filling material in the quilt or quilted blanket. Moreover, the fixedly arranged stock rolls allow only a minor lateral displacement of the material holding carriage and thus restrict the patterning possibilities of the quilting or stitching operation.

Furthermore, in this prior art quilting machine it is very difficult to clean the not exactly aligned superposed edges of the individual fabric material webs and padding or filling webs without incurring an untolerable loss of material, and additionally, requiring a considerable amount of time.

In U.S. Pat. No. 3,044,426, granted July 17, 1962, there is disclosed a stitching machine in which the cut layers of fabric and padding materials are assembled in superposed relation and clamped in a frame outside the stitching machine. An exact positioning of the assembled layers of materials is possible in this known stitching machine, but a continuously operating and economical production is not possible, because after each quilting or stitching operation the frame together with the completed work unit has to be replaced by an alternative frame with a new framed assembly of materials.

An apparatus and method for reducing waste in tufting is known from U.S. Pat. No. 4,432,296, granted Feb. 21, 1984. The carpet backing is folded along the margins as a seam and then sewn to assure presenting a desired width of backing to the tufting needles in proper position. In this way there can be avoided the necessity for making an excessive width of carpet in order to assure an adequate usable width of finished carpet. Waste is thereby avoided. The sewing of the seam is effected by a sewing machine, which is synchronously driven by the tufting machine and which continuously forms the seams and sews in accordance with the tufting feed.

In French Pat. No. 526,716, granted July 7, 1921, there is disclosed a device for sewing together webs of material along the lengthwise sides thereof. This sewing device for embroidery articles has a movable or traveling sewing machine, in order to produce absolutely straight seams. Before the webs of material can be sewn together, these material webs must first be superposed and stretched or tensioned on a table by means of clamping elements, whereby the margins to be sewn must project beyond the table edge and come to lie within the range of the movable or traveling sewing machine.

This known device for sewing together webs of material renders possible the production of straight seams, but the sewing together of different layers of loosely superposed webs of material and padding webs is not possible.

SUMMARY OF THE INVENTION

Therefore with the foregoing in mind it is a primary object of the present invention to provide a new and improved method of, and apparatus for, the processing of textile material webs, especially for the manufacture of quilts and the like and which does not suffer from the aforementioned drawbacks and shortcomings of the prior art constructions.

A further more specific object of the present invention is directed to providing a new and improved method of, and an apparatus for, the processing of material webs in a continuous section-by-section manufacture of quilts and the like, in which a mutual displacement of the individual material webs before and during the quilting or stitching operation can be avoided.

Yet a further significant object of the present invention aims at providing a new and improved construction of an apparatus for the processing of textile material webs and which apparatus is relatively simple in construction and design, quite economical to manufacture, highly reliable in operation, not readily subject to breakdown and requires a minimum of maintenance and servicing.

Now in order to implement these and still further objects of the invention, which will become more readily apparent as the description proceeds, the method aspects of this development, among other things contemplate clamping the textile material by clamping these textile material webs by a first clamping device disposed upstream of the tenter frame and a second clamping device disposed downstream of the tenter frame. The closed second clamping device then may be shifted in a predetermined direction of travel of the textile material webs for stretching these webs. This shifting is adequate for applying the requisite stretching tension to the workpiece to be quilted. The previously quilted workpiece or work unit is released from the tenter which is then moved to a position for engaging the new workpiece to be quilted. It would be also possible at this time to shift or again shift the second clamping device in order to stretch or re-stretch the new workpiece to be quilted. This new workpiece to be quilted is then stretched by clamping the textile material webs at toothed segments laterally arranged at the tenter frame and tensioning the workpiece in the transverse direction with respect to the predetermined direction of travel The transver tensioning of the textile material webs entails positioning the workpiece by moving first tenter means so as to rest against a predetermined stop, holding the workpiece under tension by second tenter means and subsequently closing clamping devices which are located at the front or downstream end and the rear or upstream end of the tenter frame and which clamping devices extend transversely relative to the workpiece.

There is then released the first clamping device located upstream of the tenter frame, and the tenter frame together with the new stretched workpiece to be processed is guided towards a receiving end of the quilting machine and there is simultaneously withdrawn new cover material webs and filler or padding material webs from the material stock located at a feed station at the upstream end of the quilting machine. The margins or marginal portions of the new cover material webs and filler material webs are joined or connected during the withdrawal of the material webs. The workpiece which has been stretched or tensioned in the tenter frame is quilted by means of a sewing device. Due to the forward and rearward guidance of the tenter frame below the sewing device, there is formed a new quilted workpiece or work unit.

As alluded to above, the invention is not only concerned with the aforementioned method aspects, but also deals with an improved apparatus for the processing of textile material webs, especially for the incremental or section-by-section manufacture of multi-layer quilts and the like. According to the invention, such quilting apparatus comprises a feed or delivery station with a stock or supply of textile material webs including cover material webs and filler or padding material webs, a tenter frame in which a workpiece formed of such textile material webs is stretched, and a device for joining or connecting the lateral edges or marginal portions of the cover material webs and the filler material webs. Such a joining or connecting device is provided on each lateral side of the path of travel or conveyance of the workpiece and are each arranged between the feed or delivery station and the tenter frame. These joining or connecting devices join or connect the web edges or marginal portions or margins during each drawing-in operation of unprocessed or fresh cover material webs and filler or padding material webs.

A device for cutting and separating the margin or selvedge of superposed textile material webs located beyond the seaming or seam produced by the joining or connecting device can be provided either upstream of, at or downstream of each joining device.

A particularly preferred embodiment of the inventive apparatus is characterized in that the joining o connecting device is structured as an overlock sewing machine which simultaneously cuts and separates the associated margin or marginal portion or selvedge of the superposed textile material webs which extend beyond the seaming or seam produced by the sewing machine.

Each such joining or connecting device which may have an associated cutting and separating device can be advantageously structured as an edge or margin-welding heat source in an ultrasonic welding installation.

For the stretching of the workpiece or work unit in the tenter frame there are advantageously provided a first clamping device arranged upstream of the tenter frame and a second clamping device arranged downstream of the tenter frame.

Furthermore, means for holding the workpiece or unit are laterally arranged along the edges or margins or marginal portions of the workpiece or work unit, and guiding means are provided such that at least one of the holding means is outwardly displaceable for laterally stretching the workpiece by applying an adjustable force.

Surprisingly, it is now rendered possible to mutually fix or fasten the cover material webs as well as the filler or padding material webs up to the point in time of stretching thereof in the tenter frame. This facilitates the stretching and alignment of the material webs in the tenter frame by seams applied laterally along or down the two edges or margins or marginal portions of the ingoing, loosely superposed webs of cover material and webs of filler or padding material. Simultaneously with the sewing or basting of the superposed textile material webs, the web parts or portions, i.e. the selvedges lying beyond the seams can be separated by means of an associated cutter or cutting device either arranged at, upstream or downstream of the related sewing device. This separating or cutting operation can be effected in such a manner that the workpiece or work unit entering the tenter frame already contains an accurately presettable width which generally corresponds with the width of the finished product. After the quilting or stitching operation, the cut and sewn margins or marginal portions of the textile material webs can be employed as ready-made seams not requiring any further working operation. The loss or waste of material is considerably smaller, because the edges or margins or marginal portions of the webs are feedable to the joining or connecting devices in an accurately positioned formation and therefore only an extremely narrow selvedge or strip has to be separated or cut off at each side of the workpiece or work unit.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the quilting apparatus or machine for the processing of textile material webs has been illustrated therein as is needed to enable one skilled in the art to readily understand the underlying principles and concepts of this invention.

Figure 1:
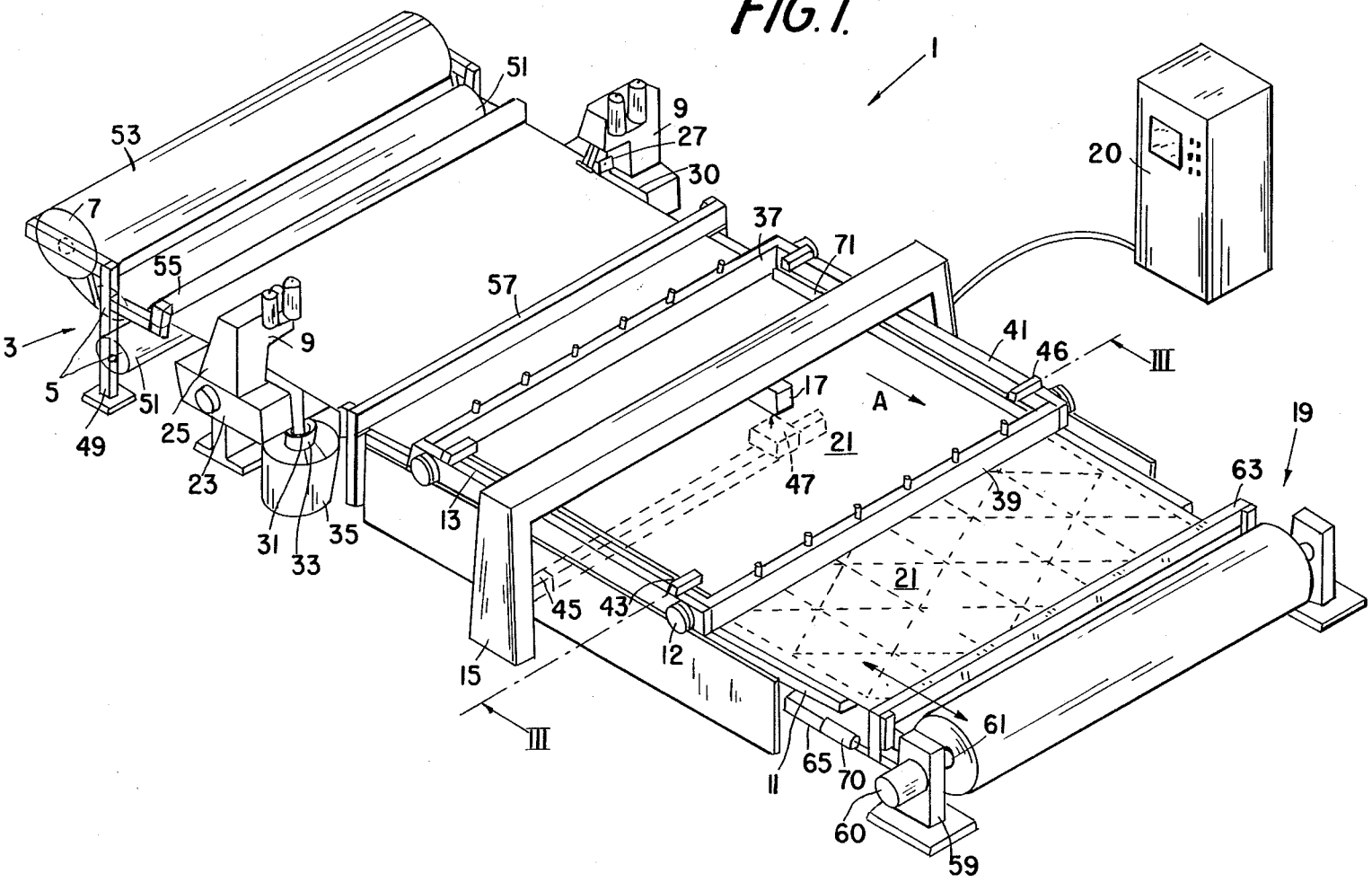
FIG. 1 is a perspective illustration of an exemplary embodiment of the inventive quilting apparatus or machine for the processing of textile material webs and useful for the practice of the method of the present development.

Turning attention now specifically to the exemplary embodiment of quilting apparatus as schematically depicted in FIG. 1 of the drawings, and suitable for the performance of the inventive method, the structure illustrated therein by way of example and not limitation, will be seen to comprise a quilting or stitching machine 1 for processing textile material webs. This quilting or stitching machine 1 comprises a feed or delivery station 3 equipped with two cover material rolls or rollers 5 and one or several filler or padding material rolls or rollers 7. There is also provided at each side of the quilting machine 1 a cutting and sewing device 9 located downstream of the upstream disposed feed station 3. There is also provided a bed 11 for accommodating a tenter frame or frame unit 13 movable on rolls 12 along the bed 11. A beam or yoke 15 extends transversely of and bridges the bed 11 and the tenter frame 13 from above. At the beam or yoke 15 one or several sewing heads 17 or the like, are movably mounted for transverse movement relative to the direction of travel of the tenter frame 13. At the downstream end of the quilting machine 1 there is arranged a receiving station 19 for the reception or accommodation of a quilted workpiece or work unit 21. This workpiece 21 can be a quilt, a sleeping bag or, generally speaking, a starting product for ready-made articles or also a technical product, which contains apart from or in addition to flat textile webs also flat webs of plastic material or metal foils or nettings.

The control of the quilting or stitching machine 1 is effected by a suitable microprocessor which is arranged remote from the quilting or stitching machine 1 and which is accommodated in a housing 20 together with the required operating or control elements. The construction and the mode of operation of the upstream located feed or delivery station 3, of the downstream located receiving station 19 as well as of the beam or yoke 15 with the sewing head or heads 17 are not subject matter of the present invention and thus shall be hereinafter described only to the extent needed to readily understand the present invention.

Each cutting and sewing device 9 is arranged upon a stand or support 23 which can extend across the entire width of the webs of the workpiece 21 and is located beneath such machines 25 structured in a mirror-image relationship are displaceably mounted on the stand or support 23 for transverse movement relative to the webs of the workpiece 21. Instead of overlock sewing machines 25, other sewing machines could also be used and equipped with a cutter or cutting device for cutting the edges or selvedges or marginal portions of the webs to be processed. Such cutting devices can be arranged before, at or after the sewing location.

Figure 2:
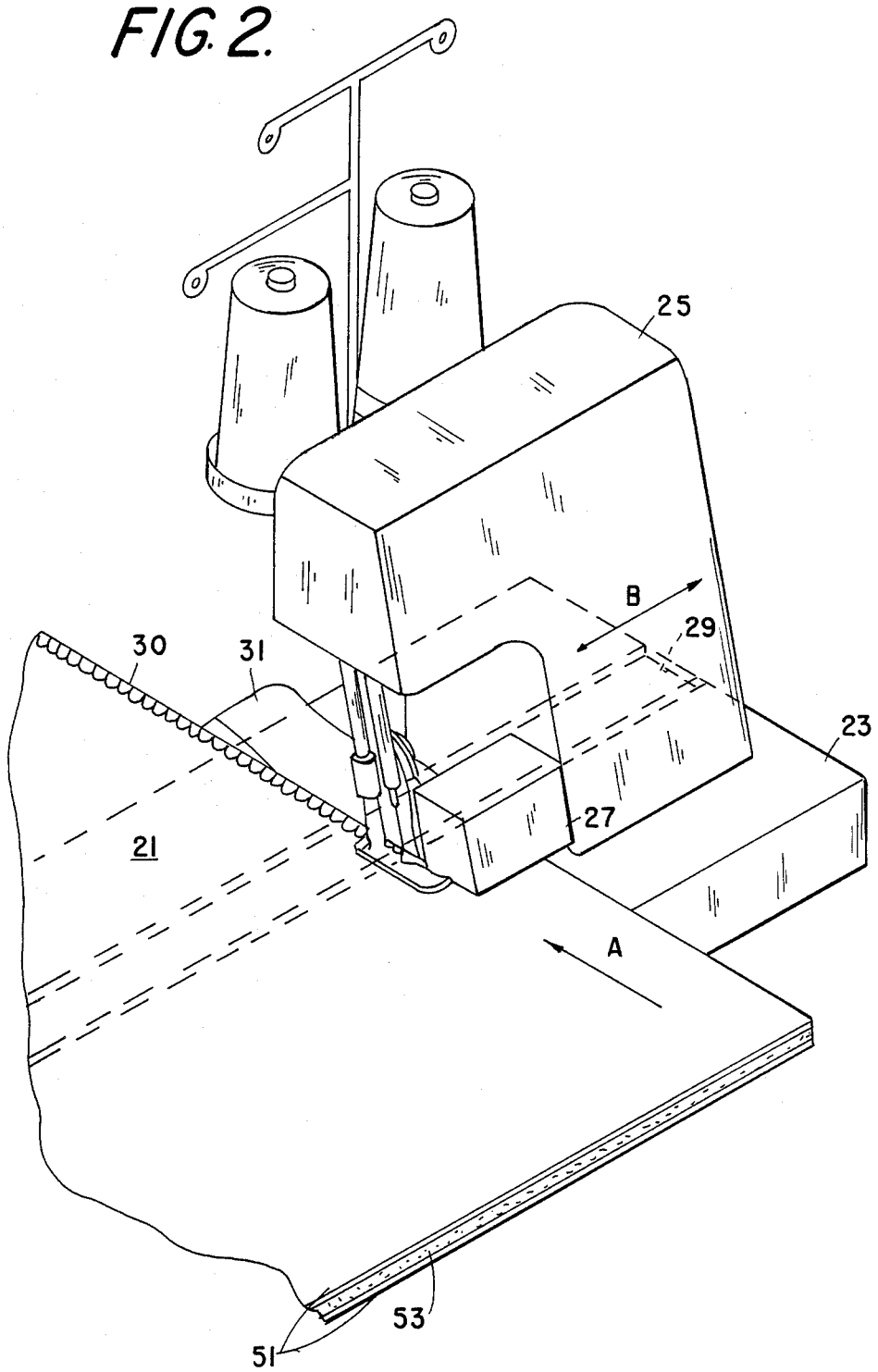
FIG. 2 is a schematic illustration of a sewing and cutting station used in the quilting apparatus or machine of FIG. 1.

In FIG. 2 there will be recognized on an enlarged scale one of the overlock sewing machines 25 and a related cutter or cutting device 27. This cutter or cutting device 27 can be equipped in conventional manner with knives or with another separating or severing device, for example, a laser or water jet cutting apparatus.

Each overlock sewing machine 25 is connected at the lower end thereof with the associated stand or support 23 and can be shifted or displaced in an associated groove or slot 29 defining a guide or on a not particularly shown rail in the direction of the double-headed arrow B and locked in every desired position, in order that webs of the workpiece 21 of different or variable width can be processed in the quilting or stitching machine 1.

The webs of the workpiece 21 sewn by the overlock sewing machines 25 are transported or conveyed in the direction of the arrow A. The separated or detached selvedges or marginal portions 31 are led away from the webs of the workpiece 21 and, if necessary, each selvedge or marginal portion 31 can be fed by a conventional device 33 for removal by suction to a collecting receiver or bin 35 close by or beneath the quilting or stitching machine 1.

Pneumatically or mechanically actuated or operated pairs of clamp or clamping bars or bar members 37 and 39 co-operating in pairs are each mounted at the front or upstream end and at the rear or downstream end of the tenter frame or frame unit 13. These pairs of clamp bars or ledges 37 and 39 hold the workpiece or work unit 21 lying therebetween tightly along a line extending transversely to the direction of web travel or conveyance A. Not particularly illustrated rubber profiles or needles can be provided at the pairs of clamp bars 37 and 39 for raising or increasing the clamping action or capacity.

Clamping means 43 and 46 are arranged along the lateral supports 41 of the tenter frame 13. Such clamping means 43 and 46 hold and stretch the workpiece or work unit 21 transversely to the direction of web travel or conveyance A. On the one side of the tenter frame 13 as seen at the left in FIG. 3, the clamping means 43 could be stationarily mounted and to function simultaneously as a lateral stop for the workpiece 21. On the opposite side, the clamping means 46 are displaceably secured for transverse movement relative to the direction of travel or conveyance A.

In a preferred embodiment of the invention, there are, however, provided pneumatically or mechanically displaceable clamping or tenter means 43 and 46 for holding and stretching the workpiece 21. These clamping or tenter means 43 nd 46 are arranged on both sides of the workpiece 21 for transverse movement relative to the direction of travel or conveyance A of the webs or workpiece 21, and the shifting or displacement range of the one clamping means 46 is here shown to be limited on the one side by an adjustable stop 42 or impact member. The clamping means 43 and 46 are either mutually secured at a stretching beam or individually subjectable to an adjustable force by means of pneumatically or mechanically actuatable piston-cylinder units 44 each associated with one of the clamping means 43 and 46.

Figure 3:
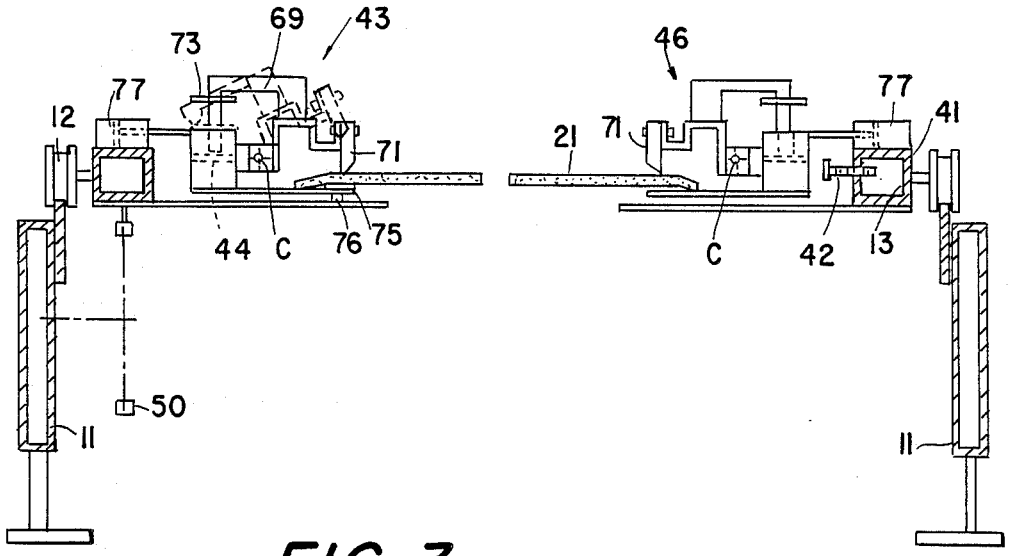
FIG. 3 is a cross-sectional view taken substantially along the line III—III in FIG. 1.

In the embodiment illustrated in FIG. 3, the clamping means 43 and 46 each comprise a double-armed lever or lever member 69 which is pivotally mounted at the tenter frame 13 for movement about an axis C disposed substantially parallel to the direction of travel or conveyance A of the workpiece 21. A toothed segment 71 is secured at the inner or inside located end of the associated double-armed lever 69. This toothed segment 71 comes to rest at a guide plate 75. The outer or outside located end of the double-armed lever 69 acts against a piston or piston member 73 of the associated one of the piston-cylinder units 44 with which the double-armed lever 69 is pivotable. The double-armed lever 69 and the guide plate 75 are conjointly displaceable on a guide arrangement or guide rolls or rollers 76 for transverse movement relative to the direction of travel or conveyance A of the workpiece 21 by means of a further substantially horizontally disposed pneumatic cylinder 77.

The work surface bounded by the tenter frame 13 is devoid of struts or braces traversing or extending across the work surface.

As indicated in FIG. 3, the forward and rearward movements of the tenter frame 13 can be effected by a linear drive, for instance a spindle drive, an electronic controlled motor or by a belt or chain drive 50.

The sewing head 17, which is already known in the art in conjunction with quilting or stitching machines of applicant, is journalled at the beam or yoke 15 by a spindle in a precise guidance extending across the entire width of the tenter frame 13. This sewing head 17 can be moved by steps or continuously by a suitable electronic control drive. Beneath the tenter frame 13 and parallel to the beam or yoke 15 there is arranged a gripper device 47 with the lower stitching thread in a further longitudinal guidance mounted at the beam or yoke 15. This gripper device 47 with the lower stitching thread is synchronously movable and drivable with the sewing head 17, in order that a faultless seaming is achieved by quilting or stitching and that a high rate of stitching is possible. The drive of the sewing head 17 and of the gripper device 47 can be effected by separate electronic mutually synchronized individual motors or by a common motor.

The drives of the sewing head or heads 17 and the gripper device or devices 47 and the drive of the tenter frame 13 are also electrically or mechanically synchronized with one another.

The upstream arranged cover material rolls 5 and the filler or padding material rolls 7 of the feed or delivery station 3 are rotatably mounted at correspondingly dimensioned stands or supports 49. A pair of rolls 55 or a not particularly illustrated intake or infeed plate can be provided at the stands or supports 49 to bring together the two cover materials or webs 51 and therebetween the one or several filler or padding materials or webs 53 of cotton batts or the like, expanded plastics or fleece. In addition to the pair of rolls 55, there is arranged a clamping beam or beam member 57 or a not particularly illustrated pair of clamping rolls at the downstream or outlet side of the cutting and sewing devices 9. The clamping beam 57 can be structured in one part or several parts and is adapted to hold the material webs under tension.

The downstream located receiving station 19 for the quilted or stitched workpiece 21 comprises a stand or support 59 mounted at the bed 11 or standing on the floor. A receiving roll 61 is mounted at the stand or support 59 and is drivable by means of a suitable drive motor 60. A clamping device 63 in the form of a pair of clamping beams or of a not particularly illustrated pair of clamping rolls is also provided upstream of the receiving station 19. This clamping device 63 is displaceable in the direction of travel or conveyance A of the workpiece 21 and controllable with an adjustable force. The displacement or shifting is preferably effected by a pneumatic cylinder 70 which acts laterally or below at the clamping device 63, and a shaft is journalled at the clamping device 63 as a protection against canting or tilting of the clamping beams of the clamping device 63 sliding at laterally arranged guidances or guides. At each end of this shaft there is secured a gear wheel, each of which meshes with a rack at the related lateral support 41 at the tenter frame 13.

A table or table member 65 mounted at the stand or support 59 of the receiving station 19 projects beneath the tenter frame 13 or beneath the bed 11 in such a manner that the workpiece 21 coming from the tenter frame 13 and leading to the receiving station 19 is deflectable at and intermediately storable on the table 65 during the quilting or stitching operation, without the workpiece 21 coming into contact with the receiving roll 61 disposed therebelow.

The individual or single elements of the quilting or stitching machine 1 can be arranged on a common machine frame or mounting or—as shown in the Figures of the drawings—on separate stands or supports 23, 49 and 59.

The steps of the inventive method will be hereinafter explained and commented on in greater detail. The end of a complete quilting or stitching cycle is selected as the starting point for the explanation of the general chronological order or sequence of the quilting method steps. At this starting point, the quilted workpiece or work unit 21 is still stretched in the tenter frame 13.

To begin with, a reserve or stock 67 of a completed quilted workpiece 21 located between the downstream or outgoing-end pair of clamp bars 39 and the opened clamping device 63 and present between the receiving station 19 and the pair of clamp bars 39, and which reserve or stock 67 previously allowed for the free longitudinal movement of the tenter frame 13 beneath the sewing head or heads 17, is rolled or wound upon the receiving roll 61. For this purpose, the tenter frame 13 is moved fully to the right or downstream end of the quilting machine 1. The webs of the workpiece 21 now lie stretched out in the quilting or stitching machine 1.

After winding up the reserve or stock 67, the clamping device 63 is closed and then preferably simultaneously shifted or displaced by the pneumatic cylinder 70 in the web or workpiece direction of travel or conveyance A toward the receiving roll 61. According to the material of the workpiece 21, the latter is stretched or tensioned to a greater or lesser extent by the corresponding pressure prevailing in the pneumatic cylinder 70.

Figure 4:
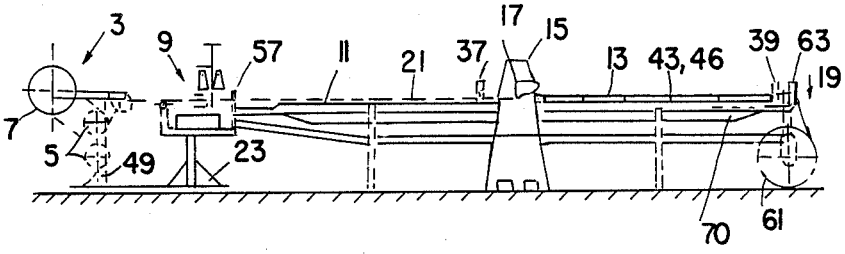
FIG. 4 shows a schematic lateral view of the inventive quilting apparatus depicted in FIG. 1 in a first work position, in which the quilted workpiece or work unit is released from the tenter frame.

Now the tenter means 43 and 46 holding the workpiece 21 so as to be tensioned at all sides at the tenter frame 13 are released. Specifically, there are first laterally released the pneumatic cylinders 77 and then the transversely extending pairs of clamp bars 37 and 39 and the toothed segments 71, as depicted in FIG. 4.

The quilted workpiece 21 is still held by the clamping device 63, in order that the tenter frame 13 can travel to the left or in upstream direction and thus be charged or loaded with an unquilted section of the webs of the next workpiece or work unit 21, without withdrawing material out of the receiving station 19.

Figure 5:
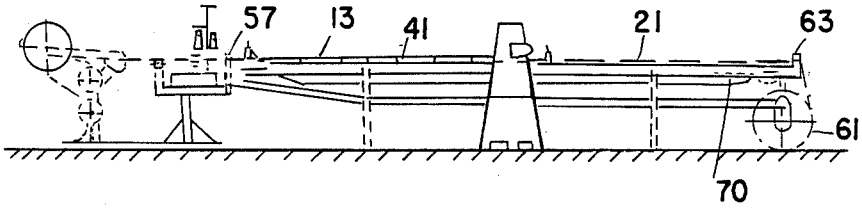
FIG. 5 shows a schematic lateral view of the inventive quilting apparatus depicted in FIG. 1 in a second work position, in which the free tenter frame is loaded or charged with an unquilted workpiece or work unit.

The previously finish processed workpiece 21 now lies stretched out between the front end pair of clamp bars 39 and the clamping device 63; the new workpiece 21 to be quilted is disposed entirely within the tenter frame 13, as depicted in FIG. 5.

The clamping of the workpiece 21 in the tenter frame 13 follows as the next method step. To begin with, the tenter means 43 and 46 arranged along the lateral supports 41 clamp the workpiece 21 between the toothed segments 71 and the associated guide plates 75 by pivoting the double-armed levers 69. Thereafter, the tenter means 46 are moved outwardly up to the adjusted stop 42. The workpiece 21 is then stretched or tensioned by the tenter means 46 in the transverse direction relative to the direction of travel or conveyance of the tenter frame 13. The pairs of clamp bars 37 and 39 are thereupon moved in pairs against one another and the workpiece 21 thus is fixedly clamped in the tenter frame 13.

Figure 6:
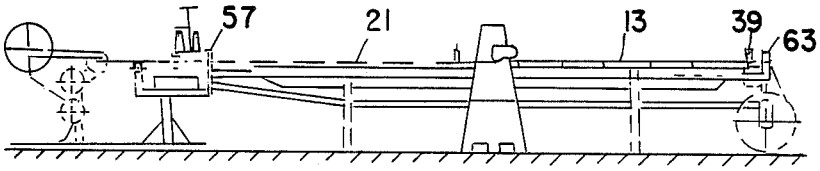
FIG. 6 shows a schematic lateral view of the inventive quilting apparatus depicted in FIG. 1 in a third work position, in which the loaded or charged tenter frame is moved to the downstream located receiving end of the quilting apparatus.

After releasing the upstream-side clamping beam 57, the freshly loaded or charged tenter frame 13 is moved to the right by one length of the tenter frame 13 and the two cover materials 51 as well as the filler or padding material or materials 53 are drawn off the cover material rolls 5 and the filler material roll or rolls 7, respectively, as depicted in FIG. 6. During passage through the cutting and sewing devices 9 during the delivery of the cover materials 51 and the filler material or materials 53, the loosely superposed material webs are laterally cut to size and joined at their sides by overlock seams 30. Finally, the clamping beam 57 is again closed so that the needles of the cutting and sewing devices 9 are not exposed to any load.

Figure 7:
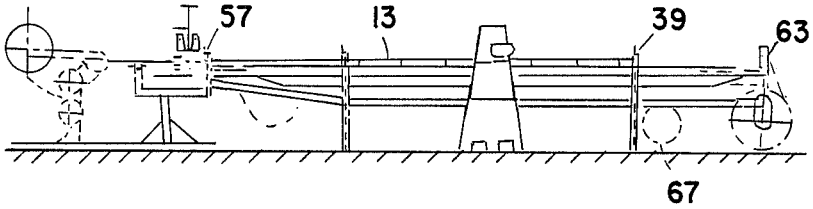
FIG. 7 shows a schematic lateral view of the inventive quilting apparatus depicted in FIG. 1 in a fourth work position, in which the loaded or charged tenter frame is reciprocated or guided forth and back beneath the sewing head.

Now the tenter frame 13 can return to the upstream side of the quilting or stitching machine 1 and the quilting operation can begin, as depicted in FIG. 7, by coordinated displacement of the sewing head 17, or sewing heads 17 should a plurality of sewing heads be provided, of the gripper device 47 and/or of the tenter frame 13. Naturally, the operation could commence also without previously returning the tenter frame 13 to the upstream side of the quilting or stitching machine 1.

After completing the quilting operation, during which the tenter frame 13 is guided several times beneath the beam or yoke 15 and the sewing head or heads 17 are transversely moved relative to the direction of travel or conveyance A of the workpiece 21, the cycle can start anew by withdrawing the reserve or stock 67 as previously explained.

It stands to reason that a laterally movable tenter frame 13 could be provided in place of the movable or travelling sewing head or heads 17. Instead of sewing together the edges or margins of the material webs, the joining or connection of such edges or margins can also be accomplished by welding and cutting under the action of heat or ultrasonics, depending upon the material composition.

While there are shown and described present preferred embodiments of the invention, it is to be distinctly understood that the invention is not limited thereto, but may be otherwise variously embodied and practiced within the scope of the following claims.

What we claim is:

1. A method of processing textile material webs, especially for the manufacture of quilts and the like in a quilting machine, comprising the steps of:

clamping the textile material webs by means of a first clamping device disposed upstream of a tenter frame and a second clamping device disposed downstream of the tenter frame; for processing a workpiece;

stretching the textile material webs between the first clamping device and the second clamping device;

clamping the textile material webs by means of toothed segments which are laterally arranged at the tenter frame;

stretching the textile material webs in a transverse direction relative to a predetermined direction of travel of the textile material webs by shifting first tenter means so as to rest against a stop, thus positioning the workpiece, holding the workpiece under tension by second tenter means, and subsequently closing clamping devices disposed at rear and front ends of the tenter frame and extending transversely relative to the now stretched workpiece;

releasing the first clamping device disposed upstream of the tenter frame;

guiding the tenter frame with the stretched workpiece to be processed towards a receiving end of the quilting machine and simultaneously withdrawing new cover material webs and at least one filler material web from a feed station;

joining marginal portions of the textile material webs during the step of withdrawing the new cover material webs and the at least one filler material web;

quilting the workpiece stretched in the tenter frame by means of a sewing device, thus a quilted workpiece;

said step of quilting comprising moving the tenter frame and the sewing device relative to one another; and guiding the quilted workpiece out of the quilting machine.

2. The method as defined in claim 1, wherein:

there is accomplished the stretching of the textile material webs after clamping the textile material webs by means of the first clamping device and the second clamping device.

3. The method as defined in claim 1, wherein:

there is accomplished the stretching of the textile material webs after having displaced the tenter frame into a position for engaging said predetermined portions of the textile material webs.

4. The method as defined in claim 1, wherein:

said step of joining the marginal portions of the textile material webs comprises sewing together such marginal portions of the textile material webs to form seams; and severing sections of the cover materials and loose filler material located outside the formed seams.

5. The method as defined in claim 1, wherein:

said step of joining the marginal portions of the textile material webs comprises welding together such marginal portions of the textile material webs to form seams; and severing the sections of cover materials and loose filler materials located outside the formed seams.

6. The method as defined in claim 1, further including the steps of:

during said step of quilting moving the tenter frame forth and back between cover material and filler material rolls at the feed station, which rolls supply the textile material webs, and a receiving roll in a receiving station; and laying down in loop form sections of the joined textile material webs located externally of the tenter frame and located between the feed station and the clamping device disposed at the rear end of the tenter frame as well as between the receiving station and the clamping device disposed at the front end of the tenter frame.

7. The method as defined in claim 6, wherein:

said step of laying down in loop form the sections of the joined textile material webs located externally of the tenter frame and between the receiving station and the clamping device disposed at the front end of the tenter frame comprises laying down such sections upon a table by means of the second clamping device arranged upstream of the receiving station and displaceable in the predetermined direction of travel of the textile material webs.

8. The method as defined in claim 7, further including the steps of:

shifting the tenter frame towards the receiving station for the purpose of bringing forward an unprocessed section of the textile material webs;

opening the second clamping device disposed downstream of the tenter frame;

winding-up on the receiving roll a web reserve existing between the receiving station and the clamping device disposed at the front end of the tenter frame;

then closing the second clamping device disposed downstream of the tenter frame and shifting this second clamping device in the predetermined direction of travel towards the receiving station;

opening the first and second tenter means and the clamping devices disposed at the rear and front ends of the tenter frame and which hold the workpiece under tension in the tenter frame; and moving the released tenter frame across the unprocessed workpiece.

9. A method of processing textile material webs, especially for the manufacture of quilts in a quilting machine, comprising the steps of:

clamping the textile material webs by means of a first clamping device disposed upstream of a tenter frame and a second clamping device disposed downstream of the tenter frame;

stretching the textile material webs between the first clamping device and the second clamping device;

displacing the tenter frame into a position for engaging predetermined portions of the textile material webs for processing a workpiece;

stretching the textile material webs located in the tenter frame in a transverse direction relative to a predetermined direction of travel of the textile material webs and holding the workpiece under tension, and subsequently closing clamping devices of the tenter frame extending transversely relative to the now stretched workpiece;

releasing the first clamping device disposed upstream of the tenter frame;

guiding the tenter frame with the stretched workpiece to be processed towards a receiving end of the quilting machine and simultaneously withdrawing further cover material webs and at least one filler material web from a feed station;

joining marginal portions of the textile material webs during the step of withdrawing the further cover material webs and the at least one filler material web;

quilting the workpiece stretched in the tenter frame to form a quilted workpiece; and removing the quilted workpiece from the quilting machine.

* * * * *

UNITED STATES PATENT AND TRADEMARK OFFICE

CERTIFICATE OF CORRECTION

PATENT NO. : 4,883,009

DATED : November 28, 1989

INVENTOR(S) : FRANZ HASELBERGER et al

It is certified that error appears in the above-identified patent and that said Letters Patent is hereby corrected as shown below:

Column 10, line 43, after ";" (semi-colon) please delete "for processing a"

Column 10, line 44, before "workpiece" please insert --displacing the tenter frame into a position for engaging predetermined portions of the textile material webs for processing a--

Column 12, between lines 34 and 35, please insert omitted sub-paragraph --clamping lateral portions of the textile material webs at the tenter frame;--

Signed and Sealed this

Eighteenth Day of December, 1990

*Attest:*

HARRY F. MANBECK, JR.

*Attesting Officer*

*Commissioner of Patents and Trademarks*